US010233738B2

(12) United States Patent
Moore

(10) Patent No.: US 10,233,738 B2
(45) Date of Patent: Mar. 19, 2019

(54) SYSTEM AND METHOD FOR PROCESSING NATURAL GAS PRODUCED FROM A SUBSEA WELL

(71) Applicant: SUBCOOL TECHNOLOGIES PTY LTD., Perth (AU)

(72) Inventor: Richard John Moore, Perth (AU)

(73) Assignee: SUBCOOL TECHNOLOGIES PTY LTD., Perth (AU)

( * ) Notice: Subject to any disclaimer, the term of this patent is extended or adjusted under 35 U.S.C. 154(b) by 136 days.

(21) Appl. No.: 14/822,464

(22) Filed: Aug. 10, 2015

(65) Prior Publication Data

US 2017/0037720 A1 Feb. 9, 2017

(51) Int. Cl.
*E21B 43/36* (2006.01)
*E21B 36/00* (2006.01)

(52) U.S. Cl.
CPC ..... *E21B 43/36* (2013.01); *E21B 36/001* (2013.01)

(58) Field of Classification Search
CPC ..... E21B 43/36; E21B 17/01; E21B 36/001
(Continued)

(56) References Cited

U.S. PATENT DOCUMENTS 6,003,603 A 12/1999 Breivik et al.
2006/0260468 A1* 11/2006 Amin ..... B01D 53/265 95/153

(Continued)

FOREIGN PATENT DOCUMENTS

CA 2840842 A1 1/2013
WO 1996/017766 A1 6/1996

(Continued)

OTHER PUBLICATIONS

UTC2013 Programme—Global Subsea Challenges—managing the old and the new, Underwater Technology Conf., Bergen. Norway (Jun. 19-20, 2013) (www.utc.no).

(Continued)

*Primary Examiner* — Matthew R Buck
*Assistant Examiner* — Patrick F Lambe
(74) *Attorney, Agent, or Firm* — Douglas W. Rommelmann; Bracewell LLP

(57) ABSTRACT

A system and method for processing natural gas produced from a subsea well is disclosed. The system includes a subsea processing system configured, in use, to receive a natural gas produced from a subsea well, separate free and condensable liquids comprising water and, optionally, liquid hydrocarbons therefrom, and produce a dry single phase gas. The system also includes a surface production facility having a processing system located thereon for processing the free and condensable liquids separated in the subsea processing system and one or more risers for transporting the separated free and condensable liquids to the processing system on the surface production facility. The dry single phase gas produced in the subsea processing system is transported to an onshore production facility via a subsea pipeline. The subsea processing system operates at high pressure and the processing system on the surface production facility operates at low pressure. Hydrocarbon liquids processed on the surface production facility may be combined with the dry single phase gas to produce a dry dense phase for transport via the subsea pipeline.

30 Claims, 6 Drawing Sheets

(58) Field of Classification Search
USPC ..... 166/357
See application file for complete search history.

(56) References Cited

U.S. PATENT DOCUMENTS

| | | | |
|---|---|---|---|
| 2012/0285656 | A1 | 11/2012 | Moore |
| 2015/0013539 | A1 | 1/2015 | Eriksen et al. |

FOREIGN PATENT DOCUMENTS

| | | | | |
|---|---|---|---|---|
| WO | 2002/101277 | A2 | 12/2002 | |
| WO | 2008147219 | A1 | 12/2008 | |
| WO | 2009/016140 | A2 | 2/2009 | |
| WO | 2011008101 | A1 | 1/2011 | |
| WO | 2011/112102 | A1 | 9/2011 | |
| WO | 2012/151635 | A1 | 11/2012 | |
| WO | 2012151634 | A1 | 11/2012 | |
| WO | 2013004275 | A1 | 1/2013 | |
| WO | 2014079515 | A1 | 5/2014 | |
| WO | WO 2014079515 | A1 * | 5/2014 | ..... C10L 3/08 |
| WO | 2015/018945 | A2 | 2/2015 | |
| WO | 2015/181386 | A2 | 12/2015 | |
| WO | 2016/054695 | A1 | 4/2016 | |

OTHER PUBLICATIONS

Moore, Richard—Presentation—"Lower Cost Gas Development Concepts Using Advanced Subsea Processing, with Accurate, Temperature Controlled, Subsea cooling", UTC, Fluor (Jun. 2013).
Moore, Richard, "New Lower Cost Gas Development Concepts using Advanced Subsea Gas Processing—The End of the Surface Gas Giants?", Engineers Australia & SPE (2013).
Moore, Richard—Presentation—"Lower Cost Gas Development Concepts Using Advanced Subsea Processing:—The End of the Surface Gas Giants?", Fluor (Sep. 2013).
International Search Report and Written Opinion of corresponding PCT/AU2016/050718 dated Oct. 24, 2016.
International Search Report and Written Opinion of corresponding PCT/AU2015/050613 dated Dec. 18, 2015.

* cited by examiner

SYSTEM AND METHOD FOR PROCESSING NATURAL GAS PRODUCED FROM A SUBSEA WELL

TECHNICAL FIELD

The disclosure relates to a system and method for processing natural gas produced from a subsea well. In particular, the disclosure relates to a system and method for processing a high pressure wellhead gas condensate in a subsea facility to produce a high pressure dehydrated gas stream for subsea transport and a low pressure liquid stream for surface processing. The disclosure also relates to a system and method for managing hydrates and corrosion in a subsea production system.

BACKGROUND

In the upstream oil and gas industry, there is a continued drive to minimize the costs of developing oil and gas fields, particularly those in deep waters where many of the most recent fields have been discovered. Several of these deepwater gas reservoirs have not been developed and remain commercially "stranded" (i.e. economically unviable).

The conventional approach to development of offshore gas reservoirs has been to process the oil and gas on a surface platform. Although the platform can be fixed to the seabed in shallow water, this is not viable in deeper waters where a floating surface facility is subsequently required.

Bringing high pressure gas from a deepwater subsea well up to a floating surface facility has proven to result in very large "mega-facilities" which are heavy, expensive and which tend to become uneconomic. This is due, in part, to the weight of high pressure gas risers which must be supported by the floating facility, high pressure gas piping, emergency shutdown (ESD) valves, processing vessels and safety systems.

Recent examples of "mega-facilities" include:

| Area | Platform/Field | Topsides Weight |
|---|---|---|
| Australia | Chevron Wheatstone | 35,000 tonne |
| Australia | Inpex Ichthys | 55,000 tonnes (potential to increase) |
| Norway | Statoil's Aasta Haasten | 25,000 tonnes |

Oil and gas emerges from a reservoir as a complex mixture of components including gas and hydrocarbon liquids as well as water and impurities such as nitrogen, carbon dioxide, mercaptans and hydrogen sulphide. Traditionally, this mixture was processed on the platform to remove impurities and separate gas and liquid phases. When deepwater subsea operations were first developed, it was not technically possible to perform these processing operations in a subsea environment and it was conventional practice to pipe the multiphase fluids to either a nearby facility or to shore for processing.

There is also considerable risk of hydrocarbon hydrate formation in these pipelines which operate at high pressures and ambient seawater temperature, where hydrocarbon-water hydrates can form at typically 22° C. or 23° C. at elevated pressure.

To prevent hydrate formation in pipelines, the industry has adopted several mitigation strategies including injection of chemicals such as glycol or monoethylene glycol (MEG), methanol or other low dosage hydrate inhibitors. Other mitigation strategies include pipeline insulation and application of various forms of heating such as direct electric heating (DEH) or other trace heating mechanisms.

These strategies proved very successful over short distance and moderate water depths. However, as the industry has moved to developments at greater depth or greater subsea tie-back distances, these mitigation strategies have proved increasingly expensive.

The Woodside operated Pluto pipeline, for example, completed in 2010 and operational in 2012, was the world's longest "water wet" pipeline at approximately 200 km in length. This pipelines transports mixtures of gas and water inhibited by MEG, at significant volumes at lower flowrates in particular. The significant cost of this strategy became fully appreciated once the design of the pipeline and the quantities of MEG that were required for operation became apparent.

Another risk of transporting "wet" gas, even with the use of hydrate inhibitors, in the presence of acid gas contaminants is corrosion to the inner surface of the gas pipeline. Accordingly, corrosion resistant materials are often used in pipelines, resulting in increased capital expenditure to mitigate this corrosion risk and ensure optimum pipeline lifespan and integrity.

The present invention seeks to overcome at least some of the aforementioned disadvantages.

SUMMARY

In its broadest aspect, there is disclosed a system and method for processing natural gas produced from a subsea well. In particular, the disclosure relates to a system and method for processing a high pressure gas condensate in a subsea facility to produce a high pressure dehydrated gas stream for subsea transport and a low pressure liquid stream for surface processing. The disclosure also relates to a method for managing hydrates and corrosion in a subsea production system.

According to one aspect, there is disclosed a system for processing natural gas produced from a subsea well. The system comprises:

a subsea processing system configured, in use, to receive a natural gas produced from a subsea well, separate free and condensable liquids comprising water and, optionally, liquid hydrocarbons therefrom, and produce a single phase gas;

a surface production facility having a processing system located thereon for processing the free and condensable liquids separated in the subsea processing system;

one or more risers for transporting the separated free and condensable liquids to the processing system on the surface production facility; and, a subsea pipeline to transport the single phase gas produced in the subsea processing system to an onshore production facility.

According to another aspect of the disclosure, the system comprises:

a subsea processing system configured, in use, to receive a natural gas produced from a subsea well, separate free and condensable liquids comprising water and liquid hydrocarbons therefrom, and produce a dry gas;

a surface production facility having a processing system located thereon for processing the free and condensable liquids separated in the subsea processing system;

one or more risers for transporting the separated free and condensable liquids to the processing system on the surface production facility; and a subsea pipeline to transport the dry gas produced in the subsea processing system to an onshore production facility.

According to another aspect of the disclosure, the system for processing natural gas produced from a subsea well comprises:

a subsea processing system configured, in use, to receive a natural gas produced from a subsea well, separate free and condensable liquids comprising water and, optionally, liquid hydrocarbons therefrom, and produce a dry single phase gas;

a surface production facility having a processing system located thereon for processing the free and condensable liquids separated in the subsea processing system, and for removing water from the hydrocarbon liquids to produce dry hydrocarbon liquids;

one or more risers for transporting the separated free and condensable liquids to the processing system on the surface production facility;

at least one return riser configured to transport the dry hydrocarbon liquids subsea, whereby the dry hydrocarbon liquids are combined with the dry single phase gas to produce a dry hydrocarbon fluid; and, a subsea pipeline to transport the dry hydrocarbon fluid to an onshore production facility.

The subsea processing system may be a high pressure subsea processing system. The high pressure subsea processing system may operate at a pressure of greater than 60 bar, preferably at a pressure of 60-240 bar.

The processing system located on the surface production facility may be a low pressure processing system. The low pressure processing system may operate at a pressure less than 40 bar, preferably at a pressure from 20-40 bar, and even more preferably at a pressure from 10-20 bar.

According to another aspect of the disclosure, the system comprises:

a high pressure processing system located subsea, said system being configured, in use, to receive a natural gas produced from a subsea well, separate free and condensable liquids comprising water and, optionally, liquid hydrocarbons therefrom, and produce a high pressure single phase gas;

a surface production facility having a low pressure processing system located thereon for processing the free and condensable liquids separated in the high pressure processing system;

one or more risers for transporting the separated free and condensable liquids to the low pressure processing system on the surface production facility; and, a subsea pipeline to transport the high pressure single phase gas produced in the high pressure processing system to an onshore production facility.

In one embodiment the subsea processing system comprises a first cooling stage configured in use to cool the natural gas in direct or indirect heat exchange relation with ambient seawater to above the hydrate formation temperature to produce condensable liquids comprising water, and optionally, liquid hydrocarbons;

a first separator to separate the free and condensable liquids from the cooled gas;

a means to introduce a hydrate inhibitor into the separated cooled gas;

a second cooling stage configured in use to cool the hydrate inhibitor-separated cooled gas mixture to below the hydrate temperature to condense residual condensable liquids; and, a second separator to separate the residual condensable liquids to produce a dry single phase gas.

In another embodiment, the subsea processing system comprises:

a first cooling stage configured in use to cool the natural gas in direct or indirect heat exchange relation with ambient seawater to above a water dewpoint temperature or, optionally, to below a hydrocarbon dewpoint temperature, to produce condensable liquids comprising water, and optionally, liquid hydrocarbons;

a first separator to separate the free and condensable liquids from the cooled gas;

a means to introduce a hydrate inhibitor into the separated cooled gas:

a second cooling stage configured in use to cool the hydrate inhibitor-separated cooled gas mixture to below the water dewpoint temperature to condense residual condensable liquids; and, a second separator to separate the residual condensable liquids to produce a dry single phase gas.

The first cooling stage may comprise a cooling apparatus configured in use to cool the natural gas in direct or indirect heat exchange relation with ambient seawater.

The second cooling stage may comprise a gas-gas heat exchanger in serial combination with a gas expander, whereby gas expanded by the gas expander is employed as a heat exchange medium in the gas-gas heat exchanger.

In one form, the second separator may be a dual phase separator vessel. The dual phase separator vessel may be in fluid communication with a dehydration column section. In an alternative form, the second separator may have an upper section thereof configured as a dehydration column section.

In one embodiment, the cooling apparatus may comprise a conduit for passage of the natural gas therethrough, the conduit being arranged in direct heat exchange relation with ambient seawater. Alternatively, the cooling apparatus may comprise a plurality of conduits configured in a parallel network, said network of conduits being arranged in direct heat exchange relation with ambient seawater.

In another embodiment, the cooling apparatus may comprise a first subsea heat exchanger in heat exchange relation with a cooling medium fluid from one or more subsea cooling modules. The subsea cooling modules may comprise a plurality of conduits configured in a parallel network, said network of conduits being arranged in direct heat exchange relation with ambient seawater.

In an alternative embodiment, the cooling apparatus may comprise a first subsea heat exchange in heat exchange relation with a cooling medium fluid comprising seawater directly pumped from surrounding ambient seawater.

In one embodiment, a second subsea heat exchanger may be configured upstream of the gas-gas heat exchanger. The second subsea heat exchange may be in heat exchange relation with the cooling medium fluid from one or more subsea cooling modules.

The cooling medium fluid used in the first and second subsea heat exchangers may be cooled in the one or more subsea cooling modules by heat exchange with ambient surrounding seawater.

To reduce the distances between the gas-gas heat exchanger, the expander and the separator, the gas-gas heat exchanger, the expander and the separator may be closely positioned with respect to one another or directly coupled to one another in serial combination.

In one embodiment the means to add a hydrate inhibitor into the separated cooled gas comprises an injector adapted to inject a fluid comprising the hydrate inhibitor into a flowpath of the separated cooled gas.

According to another aspect, there is disclosed a method of processing natural gas produced from a subsea well comprising:

passing the natural gas through a subsea processing system configured, in use, to separate free and condensable liquids comprising water and, optionally, gas condensate, and produce a single phase gas;

transporting the separated free and condensable liquids to a surface production facility;

processing the received free and condensable liquids in a processing system on the surface production facility; and, transporting the single phase gas to an onshore production facility via a subsea pipeline.

In another aspect of the disclosure, the method of processing natural gas produced from a subsea well comprises:

passing the natural gas through a subsea processing system configured, in use, to separate free and condensable liquids comprising water and, optionally, gas condensate, and produce a dry gas;

transporting the separated free and condensable liquids to a surface production facility;

processing the received free and condensable liquids in a processing system on the surface production facility; and, transporting the dry gas to an onshore production facility via a subsea pipeline.

In another aspect of the disclosure, the method of processing natural gas produced from a subsea well comprises:

passing the natural gas through a subsea processing system configured, in use, to separate free and condensable liquids comprising water and, optionally, gas condensate, and produce a dry single phase gas;

transporting the separated free and condensable liquids to a surface production facility;

processing the free and condensable liquids in a processing system on the surface production facility to remove water and produce dry hydrocarbon liquids;

returning the dry hydrocarbon liquids subsea, whereby the dry hydrocarbon liquids are combined with the dry single phase gas to produce a dry hydrocarbon fluid; and, transporting the dry hydrocarbon fluid to an onshore production facility via a subsea pipeline.

In one embodiment, the step of passing the natural gas through the subsea processing system comprises:

cooling the natural gas to above the hydrate formation temperature to produce free and condensable liquids comprising water and, optionally, liquid hydrocarbons;

separating the free and condensable liquids from the cooled gas;

introducing a hydrate inhibitor into the separated cooled gas to produce a hydrate inhibitor-separated cooled gas mixture;

cooling said mixture to below the hydrate formation temperature to condense residual condensable liquids; and, separating the residual condensable liquids to produce a dry single phase gas.

In another embodiment, the step of passing the natural gas through the subsea processing system comprises:

cooling the natural gas to above a water dewpoint temperature or, optionally to below a hydrocarbon dewpoint temperature, to produce free and condensable liquids comprising water and, optionally, liquid hydrocarbons;

separating the free and condensable liquids from the cooled gas;

introducing a hydrate inhibitor into the separated cooled gas to produce a hydrate inhibitor-separated cooled gas mixture;

cooling said mixture to below the water dewpoint temperature to condense residual condensable liquids; and, separating the residual condensable liquids to produce a dry single phase gas.

In one embodiment, cooling the natural gas may comprise cooling the natural gas in direct or indirect heat exchange relation with ambient seawater to condense liquids comprising the liquid hydrocarbons. Some water vapour in the natural gas may also be condensed and separated from the cooled gas.

Cooling the hydrate inhibitor-separated cooled gas mixture may comprise passing said mixture through a gas-gas heat exchanger in serial combination with a gas expander, wherein the single phase gas exiting the expander may be optionally used as a cooling medium in the gas-gas heat exchanger.

In an alternative embodiment, subsequent to cooling the natural gas to the first temperature and separating the hydrocarbon liquids, the cooled gas may undergo dehydration to remove water and produce a dry single phase gas. Dehydration may be achieved in a dehydration column, solvent absorption tower, or via separation membranes.

The separated free and condensable liquids produced in the high pressure subsea processing system may be combined and transported to the surface production facility via one or more risers operating at one or more pressures intermediate to respective operating pressures of the high pressure subsea processing system and the surface production facility. A first riser may transport free and condensable liquids comprising water and, optionally, liquid hydrocarbons, to the surface facility. A second riser may transport a mixture of hydrate inhibitor and condensable liquids to the surface facility.

In one embodiment, processing the received free and condensable liquids in the low pressure processing system on the surface production facility comprises separating water from the liquid hydrocarbons. This step may further comprise processing the separated water to remove residual hydrocarbons. The resulting processed water may then be disposed directly to the body of water or via injection in a subsea injection well.

In another embodiment, processing the received free and condensable liquids in the low pressure processing system on the surface production facility comprises separating water and hydrate inhibitor from the liquid hydrocarbons. The resulting hydrocarbon liquids may then be returned and combined with the dry single phase gas subsea for transportation to an onshore processing facility.

In one form of this particular embodiment, the hydrate inhibitor may be regenerated after separation from the free and condensable liquids. Separation may be assisted by heating the received free and condensable liquids. The resulting separated water/hydrate inhibitor mixture may subsequently undergo a process to regenerate the hydrate inhibitor which is recycled for re-injection in the subsea processing system. Separated water may be disposed, optionally with a side stream comprising soluble salts.

Alternatively, the separated hydrocarbon liquids may undergo any one of a group of processes including stabilization to a desired vapour pressure specification; separating the gas condensate into one or more hydrocarbon components by distillation; producing an off-gas for power generation; and so forth.

According to one aspect, there is disclosed a method of managing hydrates and corrosion in a subsea production system comprising:

producing a natural gas from a subsea well;

passing the natural gas through a high pressure subsea processing system configured, in use, to separate condensable liquids comprising water and, optionally, gas condensate, and produce a dry single phase gas;

transporting the separated condensable liquids to a surface production facility; processing the received condensable liquids in a low pressure processing system on the surface production facility; and, transporting the dry single phase gas in the absence of a hydrate inhibitor to an onshore production facility via a subsea pipeline.

BRIEF DESCRIPTION OF DRAWINGS

Notwithstanding any other forms which may fall within the scope of the process as set forth in the Summary, specific embodiments will now be described, by way of example only, with reference to the accompanying drawings in which.

DESCRIPTION OF EMBODIMENTS

Figure 1:
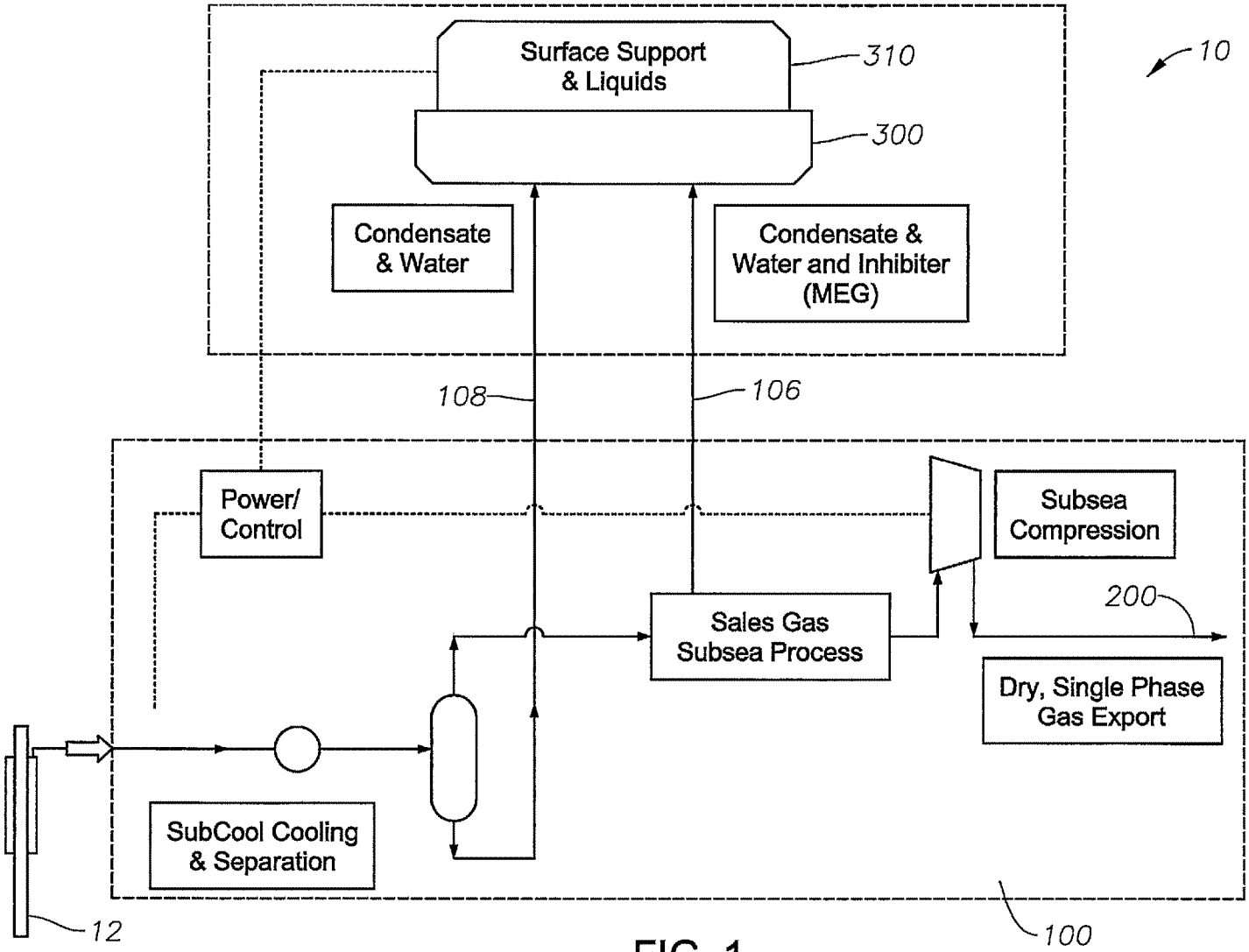
FIG. 1 is a schematic representation of one embodiment of a system for processing natural gas produced from a subsea production well in accordance with the disclosure.

Embodiments of a system and method for processing natural gas produced from a subsea well will now be described by way of example only.

Definitions

The term "subsea" as used herein refers to a location under the surface of a body of water. It will be appreciated that the body of water may be sea-based, but could equally apply to any body of water including inland or lake-based water bodies. It will be appreciated that a reference to a sea floor, sea bed, or seawater herein may equally apply to a lake floor, lake bed, or lakewater and/or freshwater and/or saltwater and/or brine, respectively, depending on the location and the character of the body of water.

"Subsea well" means a production wellhead located under the surface of a body of water on the sea bed. The subsea well is provided with a "christmas tree", in other words a collection of valves whose primary function is to control the flow of oil or gas out of the well.

The term "production facility" as used herein refers to any facility for receiving produced hydrocarbons and includes a hydrocarbon processing system. The hydrocarbon processing system is an assembly of equipment configured to process gaseous, liquid or multi-phase hydrocarbons transported to the hydrocarbon processing system. Depending on the nature and the composition of the liquid or gaseous hydrocarbons, the hydrocarbon processing system may be configured to perform any one or more of several physical processes including cooling, compressing, expanding, condensing, liquefaction, distillation, fractionation, gasification or separating contaminants and/or one or more hydrocarbon components from the liquid or gaseous hydrocarbons. Alternatively, or additionally, the hydrocarbon processing system may be configured to perform any one or more of several chemical processes to convert the hydrocarbons to a higher hydrocarbon or oxygenate, for example with a Fischer-Tropsch-type process.

The liquid hydrocarbon processing system typically operates at low pressures. The low pressure processing system may operate at a pressure less than 40 bar, preferably at a pressure from 20-40 bar, and even more preferably at a pressure from 10-20 bar. Typically, processing of gas condensate would be undertaken at a pressure in the range of 8-20 bar, decreasing towards atmospheric pressure for stabilization, final water treatment and hydrate inhibitor regeneration. In a process to produce a LPG product comprising propane and butane or mixtures thereof, the low pressure processing system operates at a pressure between 20 and 40 bar.

The gas hydrocarbon processing system typically operates at high pressures. The gas hydrocarbon processing system may operate at a pressure of greater than 60 bar, preferably at a pressure of 60-240 bar. In this disclosure, the gas hydrocarbon processing system is located subsea. In other words, the gas hydrocarbon processing system is a subsea processing system.

A "surface production facility" is a production facility located on a surface of a body of water in association with one or more subsea wells. The surface production facility may be located over or near the one or more subsea wells. The surface production facility may be a floating vessel or a semi-submersible vessel, including, but not limited to, a floating production, storage, and offloading vessel (FPSO)—the FPSO may be ship-shaped or circular; floating storage and offloading vessel (FSO); floating liquefied natural gas production vessels (FLNG); tension-leg platforms (TLPs) which are floating platforms tethered to the seabed in a manner that eliminates most vertical movement of the structure; and spar platforms which are moored to the seabed with conventional mooring lines.

An "onshore production facility" is a production facility located onshore. The onshore production facility may be in fluid communication with one or more subsea wells or subsea equipment via a flowline.

The terms "tieback", "tieback line", "riser", "production line", or "flowline" may be used interchangeably herein and refer to any tubular structure or collection of lines for transporting produced hydrocarbons to a production facility.

The term "natural gas", as used herein, refers to a raw natural gas extracted from a producing well. With reference to the present disclosure, raw natural gas is gas directly extracted from a subsea wellhead with 100% of fluid compositional flow. The composition of the wellhead gas depends on the type, depth, and location of the underground deposit and the geology of the area. Raw natural gas typically consists primarily of methane ($CH_4$) and varying amounts of heavier gaseous hydrocarbons such as ethane ($C_2H_6$), propane ($C_3H_8$), n-butane (n-$C_4H_{10}$), isobutane (i-$C_4H_{10}$), pentanes and even higher molecular weight hydrocarbons; acid gases such as carbon dioxide ($CO_2$), hydrogen sulphide ($H_2S$) and mercaptans such as methanethiol ($CH_3SH$) and ethanethiol ($C_2H_5SH$); inert gases such as nitrogen and helium; water vapour and liquid water, including dissolved salts and dissolved gases; liquid hydrocarbons including natural gas condensate and/or crude oil, mercury, and naturally occurring radioactive material.

The natural gas may contain components separable therefrom by dewpoint condensation. The term "dewpoint condensation", as used herein, refers to a process of cooling the gas to a temperature at or below a hydrocarbon dewpoint and/or a water dewpoint to condense the respective component.

The "hydrocarbon dewpoint" is the temperature (at a given pressure) at which hydrocarbon components of a hydrocarbon component-containing gas mixture will start to condense out of the gaseous phase. The hydrocarbon dew point is a function of the gas composition as well as the pressure. The term "gas condensate" refers to the one or more heavier hydrocarbons referred to above (usually pentane or higher) which transition from a gas state to a liquid state at the hydrocarbon dewpoint.

The "water dewpoint" is the temperature (at a given pressure) at which water vapour of a wet gas mixture will start to condense out of the gaseous phase. The water dewpoint is also a function of the gas composition as well as the pressure.

The term "condensable liquids" as used herein primarily refers to these separable components comprising any one or more of the heavier gaseous hydrocarbons referred to above and water.

Many components of raw natural gas (e.g. methane, ethane, propane, isobutane, carbon dioxide, nitrogen and hydrogen sulphide) may form gas hydrates, which are solid crystalline compounds that resemble compressed snow and exist above 0° C. at high pressures. Structurally, gas hydrates are inclusion compounds (clathrates) formed by trapping of gas molecules in the voids of crystalline structures consisting of water molecules. The term "hydrate formation temperature" as used herein refers to the temperature (at a given pressure) at which a hydrocarbon hydrate begins to form. Hydrate formation conditions may be predicted using commercial phase equilibria computer programs such as HYSYS, PVTsim, UNISIM and so forth.

The term "hydrate inhibitor" as used herein refers to any chemical compound capable of suppressing the hydrate formation temperature. Conventional hydrate inhibitors include glycol, methanol and low-dose hydrate inhibitors as will be well known to those skilled in the art. The term "glycol" as used herein refers to a group of glycol-like compounds including, but not limited to, glycol, monoethylene glycol (MEG), triethylene glycol and so forth.

The term "ambient seawater temperature" as used herein refers to the bulk temperature of the surrounding seawater. It will appreciated that the ambient seawater temperature may vary depending on the location of the wellhead and the location of the system. For example, the ambient seawater temperature is commonly understood to be about 4° C. However, in deepwater operations off the north-west shelf of Western Australia, the ambient seawater temperature may be 8° C., while in Arctic waters the ambient seawater temperature may be close to 0° C. The term "below ambient seawater temperature" refers to a temperature below the bulk temperature of the surrounding seawater.

System for Processing Natural Gas Produced from a Subsea Well

Referring to the Figures there is shown an embodiment of a system 10 for processing natural gas produced from a subsea well 12.

The system 10 includes a subsea processing system 100 configured, in use, to receive raw natural gas produced from a subsea well 12. Typically, the raw natural gas may be "wet" and contain free or produced water, as well as condensed water. In some, but not all embodiments, the raw natural gas may also contain gas condensate. It will be appreciated by those skilled in the art that the water dewpoint is less than the hydrocarbon dewpoint. Moreover, the hydrocarbon dewpoint may vary depending on the composition of the gas condensate in the raw natural gas and the pressure of the raw natural gas.

Accordingly, depending on the composition of the raw natural gas produced from the subsea well 12 and the desired specification of the single phase gas product, the subsea processing system 100 may include one or more processing stages to successively condense the gas condensate and water, thereby producing a dry single phase gas which is subsequently transported via a subsea pipeline to an onshore production facility 200.

The subsea processing system 100 may comprise a first subsea processing stage 150 comprising an assembly of suitable equipment to cool the raw natural gas to the hydrocarbon dewpoint to produce gas condensate and, optionally, some liquid water. The resulting condensable liquids may be separated and subsequently transported to the surface production facility 300 to undergo further processing in the low pressure processing system 310.

The subsea processing system 100 may also comprise a second subsea processing stage 160. Gas treated in the first subsea processing stage 150 may be further cooled in the second subsea processing stage 160 to the water dewpoint to condense the remaining water and produce a dry single phase gas stream. Prior to passing through the second subsea processing stage 160, a hydrate inhibitor, such as MEG, may be introduced into the gas to prevent formation of gas hydrates, particularly if the water dewpoint is likely to be less than the hydrate formation temperature.

It will be appreciated that the hydrate inhibitor may be concurrently condensed with the condensable liquids in the second subsea processing stage 160, which are then separated and transported to the surface production facility 300 to undergo further processing in the low pressure processing system 310. The bulk of the hydrate inhibitor may be regenerated in the low pressure processing system 310 and re-injected for use in the subsea processing system 100 as described above via risers. A smaller side stream of hydrate inhibitor may be processed to remove salts which are introduced therein from a start-up phase or by carry-over from the separator.

Advantageously, any water that is condensed in the first subsea processing stage 150 is likely to also contain one or more salts inherent in the raw natural gas composition. When the hydrate inhibitor is introduced into the gas prior to the second subsea processing stage 160 it is not contaminated by these salts because they have already been removed from the gas stream. Consequently, regeneration of the hydrate inhibitor in the low pressure processing system 310 on the surface production facility 300 can be achieved by simple re-boilers rather than more complex vacuum distillation methods which would otherwise need to be employed to regenerate hydrate inhibitor contaminated with salts.

The system 10 may be configured to recover separated condensable liquids recovered from the first and second subsea processing stages 150, 160 and transport them respectively via one or more risers to the surface production facility 300. Alternatively, the separated condensable liquids may be combined and transported via a single riser to the surface production facility 300 where they undergo further processing in the low pressure processing system 310.

The resulting dry single phase gas may be compressed before transporting the compressed gas to the onshore production facility 200.

Figure 2:
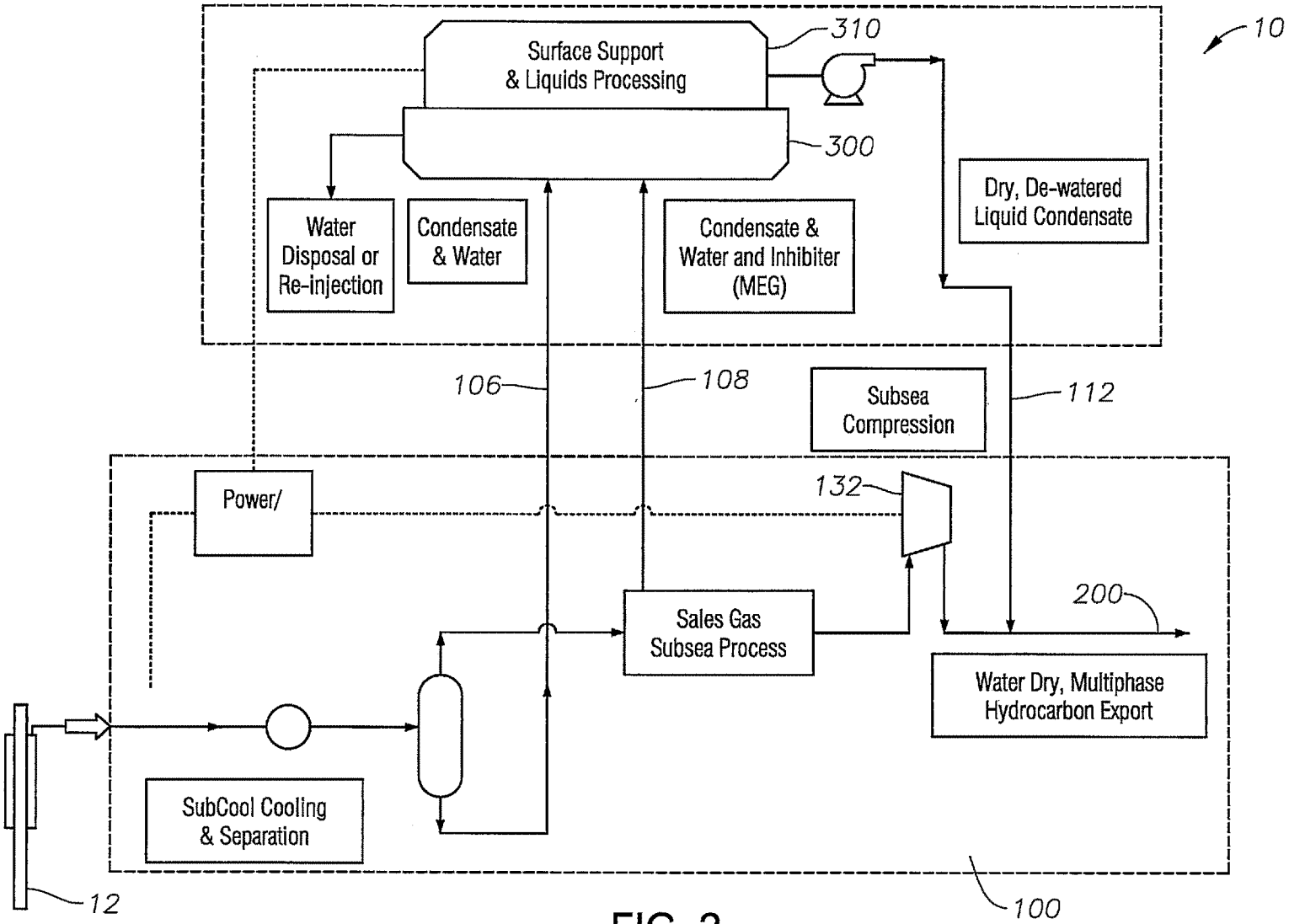
FIG. 2 is a schematic representation of an alternative embodiment of a system for processing natural gas produced from a subsea production well in accordance with the disclosure.

In the embodiment shown in FIG. 2, the mixture of condensable liquids and hydrate inhibitor received by the low pressure processing system 310 may be processed to separate liquid hydrocarbons from the mixture of condensable liquids and hydrate inhibitor. The separated liquid hydrocarbons may be returned subsea via riser 112 and combined with the compressed dry gas, thereby forming a dry dense hydrocarbon fluid which is subsequently transported to the onshore production facility 200.

Onshore Production Facility

The onshore production facility 200 may comprise an assembly of suitable equipment, as will be well known to persons skilled in the art, configured to perform any one of a group of processes in respect of the dry single phase gas. Such processes may include gas sweetening to remove acid gases and other contaminants such as carbon dioxide, hydrogen sulphide, mercaptans and mercury; compression; distillation; liquefaction; and so forth.

Low Pressure Processing System

The low pressure processing system 310 is located on the surface production facility 300 and may operate at a pressure less than 40 bar, preferably at a pressure from 20-40 bar, and even more preferably at a pressure from 10-20 bar. Typically, processing of gas condensate would be undertaken at a pressure in the range of 8-20 bar, decreasing towards atmospheric pressure for stabilization, final water treatment and hydrate inhibitor regeneration. In a process to produce a LPG product comprising propane and butane or mixtures thereof, the low pressure processing system operates at a pressure between 20 and 40 bar.

The low pressure processing system 310 may comprise an assembly of suitable equipment, as will be well known to those skilled in the art, configured to perform any one of a group of processes in respect of the condensable liquids transported to the surface production facility 300. Such processes may include separating water from the gas condensate, regenerating hydrate inhibitor, stabilization of the gas condensate to a desired vapour pressure specification; separating the gas condensate into one or more hydrocarbon components by distillation; producing an off-gas for power generation; and so forth.

In the embodiment shown in FIG. 2, the low pressure processing system 310 may be configured to separate liquid hydrocarbons from the condensable liquids received by the surface production facility 300. The separated liquid hydrocarbons may be returned subsea via riser 112 and combined with the compressed dry gas, thereby forming a dry dense hydrocarbon fluid which is subsequently transported to the onshore production facility 200.

Notwithstanding the preceding discussion, there are some circumstances where the low pressure processing system 310 may operate at pressures over 40 bar. These circumstances may include when dry hydrocarbon liquid is pressurised to a high pressure immediately prior to re-injection into the subsea export pipeline. Additionally, these circumstances may include pressurizing off-gas from stabilizing the hydrocarbon liquid, which may be used as fuel. If the composition of the hydrocarbon liquid is such that the volume of off-gas is in excess of fuel requirements, excess off-gas may be dried (via a dehydration column), recompressed and exported to the subsea gas export pipeline. It is envisaged that the flowrate would be 0-5% of the total flowrate of the main subsea gas stream. Predominantly, however, the low pressure processing system 310 operates overall at a low pressure.

Subsea Processing System

Various embodiments of the subsea processing system 100 will now be described in more detail with reference to the Figures.

The subsea processing system 100 may be located proximal to or on the seabed. The subsea processing system 100 may operate at a high pressure in a range of 60 to 240 bar, although in some embodiments the subsea processing system 100 may operate at higher pressures than 240 bar. Preferably, the subsea processing system 100 may operate at a pressure in a range of 100 to 190 bar.

In the embodiment disclosed herein, the raw natural gas contains both gas condensate and water. The first subsea processing stage 150 of the subsea processing system 100 may include a first cooling apparatus 110 to cool the raw natural gas to below a hydrocarbon dewpoint to produce liquid gas condensate and a separator to separate liquid gas condensate from the raw natural gas. It will be appreciated that some water (typically containing salts) may also co-condense with the liquid gas condensate. It will be appreciated that as this first cooling process is performed in the absence of a hydrate inhibitor, the first cooling apparatus 110 cools the raw natural gas to a temperature above the hydrate formation temperature.

The first cooling apparatus 110 may be configured to be in direct or indirect heat exchange with the surrounding ambient seawater to effect cooling of the raw natural gas to below the hydrocarbon dewpoint.

Figure 3:
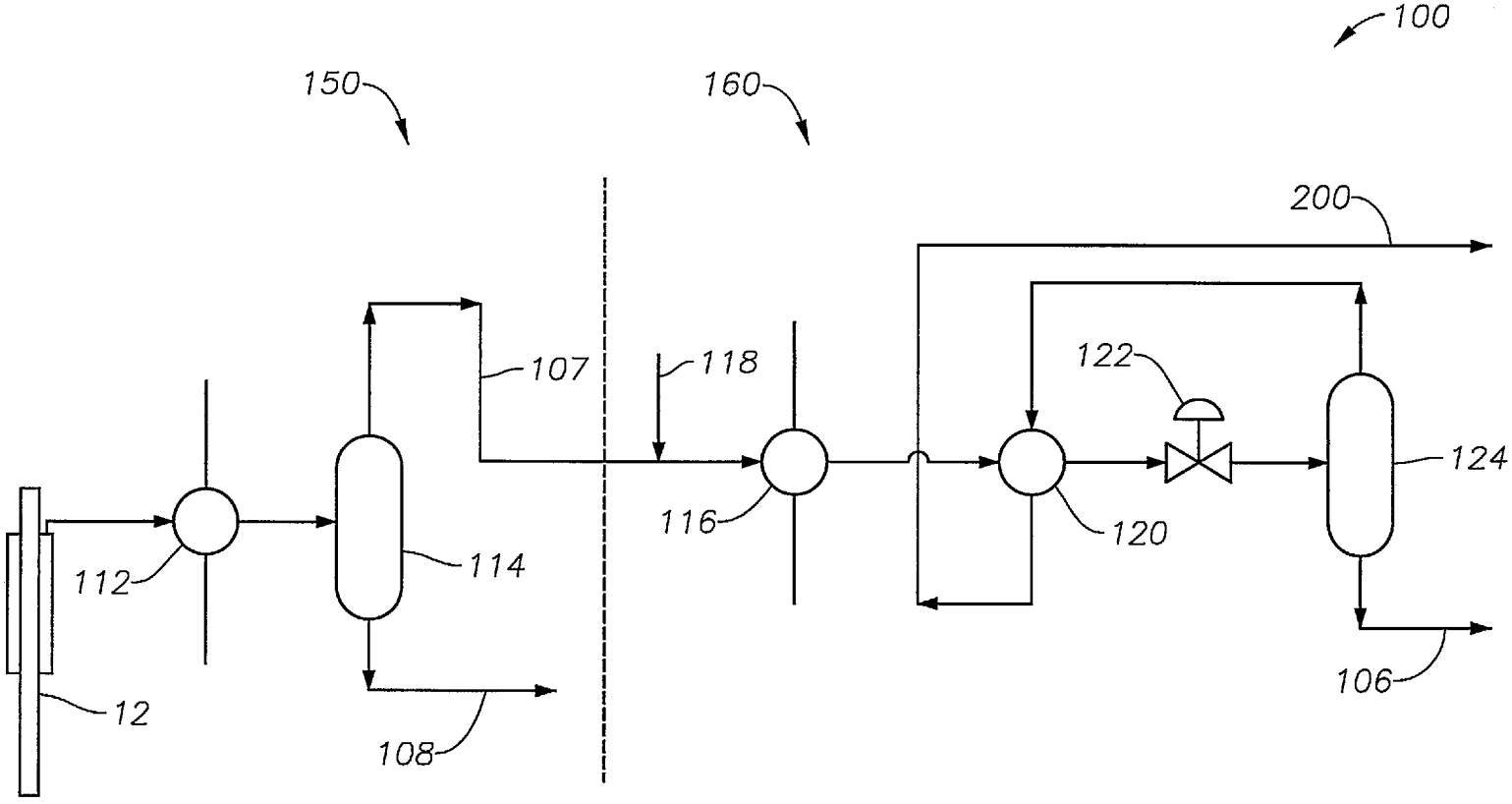
FIG. 3 is a schematic representation of one form of a subsea processing system used in the system shown in FIGS. 1 and 2.
Figure 5:
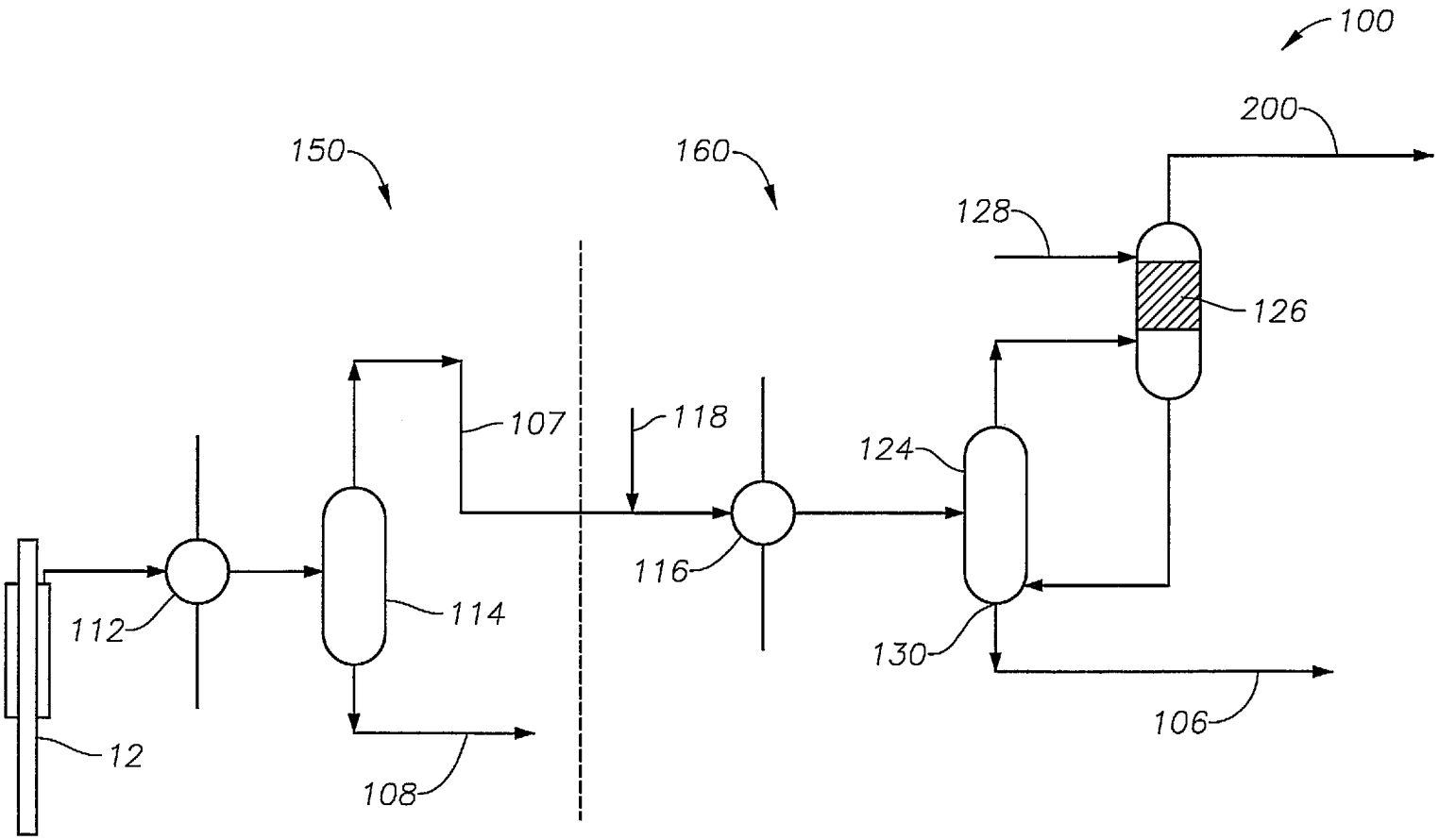
FIG. 5 is a schematic representation of a further alternative form of a subsea processing system used in the system shown in FIGS. 1 and 2; and, FIG. 6 is a schematic representation of a further alternative form of a subsea processing system used in the system shown in FIGS. 1 and 2.
Figure 6:
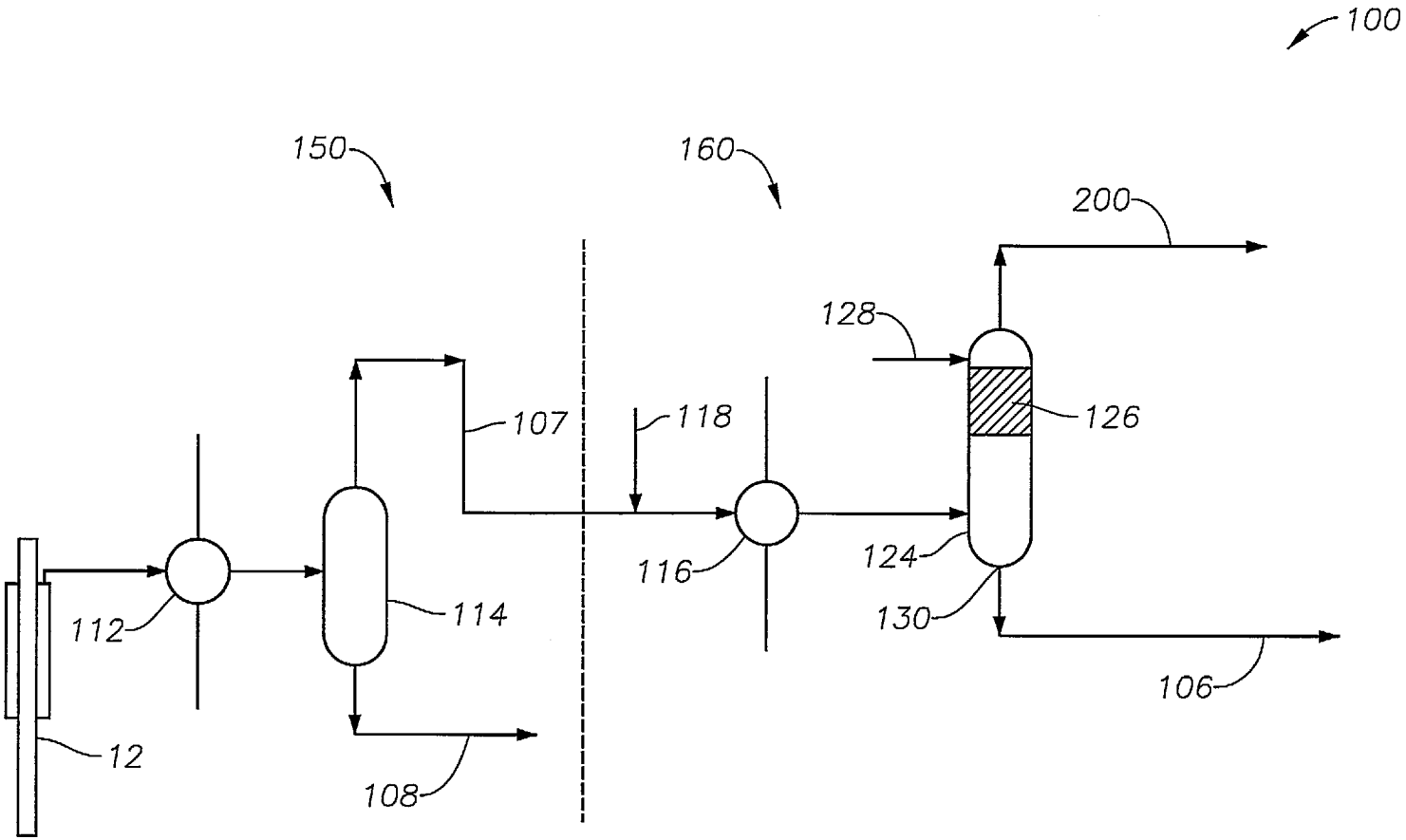

In one embodiment, as shown in FIGS. 3, 5 and 6 the first cooling apparatus 110 includes a first subsea heat exchanger 112 arranged in heat exchange communication with the raw natural gas received from the subsea well 12. The first subsea heat exchanger 112 may be of various types, such as shell & tube, or various others well understood by those skilled in the art, and may be arranged in various configurations (series/parallel) with other heat exchangers. It will be appreciated that the first subsea heat exchanger 112 may comprise conventional shell & tube heat exchanger which has been modified for subsea use.

In a preferred embodiment, the first subsea heat exchanger 112 may take the form of a hydrocarbon process fluid heat exchanger disposed subsea as described in International Application Publication No. WO2012/151635, which is incorporated in its entirety herein. In summary, in this form the first subsea heat exchanger 112 is arranged to provide heat exchange communication between the raw natural gas and a cooling medium fluid. The cooling medium fluid is circulated through a subsea cooling unit comprising one or more subsea cooling modules for cooling the cooling medium fluid. The one or more subsea cooling modules comprises a plurality of cooling pipes configured in heat exchange relationship with ambient surrounding seawater.

In use, the first subsea heat exchanger 112 is configured to cool the raw natural gas to a first temperature below a hydrocarbon dewpoint and marginally above ambient seawater temperature to condense liquids comprising one or more hydrocarbons other than methane and at least partially condense water in the wellhead gas.

Figure 4:
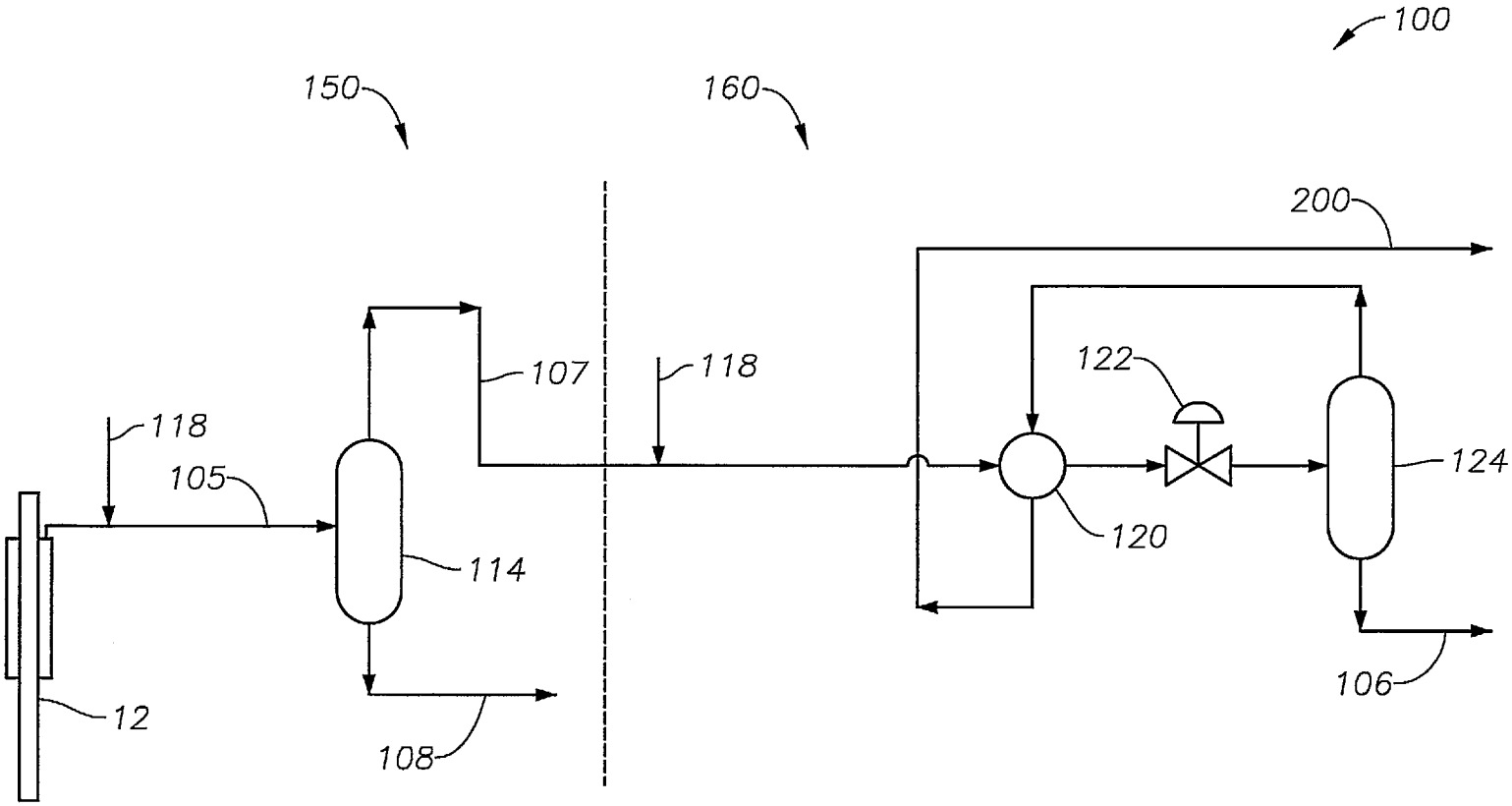
FIG. 4 is a schematic representation of an alternative form of a subsea processing system used in the system shown in FIGS. 1 and 2.

In an alternative embodiment shown in FIG. 4, the first cooling apparatus 110 omits the first subsea heat exchanger 112. Instead, the first cooling apparatus 110 relies on passive cooling to cool the raw natural gas to a first temperature below the hydrocarbon dewpoint. In the embodiment shown in FIG. 4, the raw natural gas is cooled by passing it through conduit 105 which is in direct heat exchange relation with ambient surrounding seawater. The degree of cooling of the raw natural gas will be dependent on many factors including, but not limited to, the ambient surrounding seawater temperature, the length of the conduit, residence time of wellhead gas in conduit 105, flow rate through conduit 105, and so forth. It is generally assumed that, in this particular embodiment, the length of the conduit 105 would be sufficient to ensure that the raw natural gas was cooled to a temperature marginally above ambient seawater temperature.

Alternatively, the raw natural gas may be cooled by passing it through a simple pipe network in direct heat exchange relation with ambient surrounding seawater.

It will be appreciated that with respect to the embodiment described with reference to FIG. 4, the raw natural gas will be cooled to a temperature approaching the ambient temperature of the seawater surrounding the conduit or pipe network. The ambient temperature of seawater, particularly in deepwater operations, may be below the hydrate formation temperature. In embodiments where the wellhead gas is likely to be cooled to a temperature below the hydrate formation temperature, a hydrate inhibitor (as will be described later) may be added into the wellhead gas, prior to cooling in direct heat exchange relation with ambient seawater, to avoid formation of hydrates and associated blockages or disruption to wellhead gas flow.

The first cooling apparatus 110 also includes a first separator 114 to separate the condensable liquids and water from the cooled raw natural gas. The first separator 114 is arranged in fluid communication with the first subsea heat exchanger 112 in a manner to receive the cooled gas.

The first separator 114 may take the form of any separator suitable for separating multiphase fluids, as will be well known to those skilled in the art. Exemplary separators include, but are not limited to, a pipe type or vessel type separator.

Condensable liquids comprising gas condensate and water are separated in the first separator 114 and then transported through risers 108 to the surface production facility 300 to undergo further processing in a low pressure processing system 310.

The subsea processing system 100 shown in FIGS. 3, 5 and 6 may also include a second subsea heat exchanger 116 configured downstream of the first separator 114 in an arrangement to receive the separated gas from the first separator 114. The second subsea heat exchanger 116 may be of various types, such as shell & tube, or various others well understood by those skilled in the art, and may be arranged in various configurations (series/parallel) with other heat exchangers. It will be appreciated that the second subsea heat exchanger 116 may comprise conventional shell & tube heat exchanger which has been modified for subsea use.

In a preferred embodiment, the second subsea heat exchanger 116 may also take the form of a hydrocarbon process fluid heat exchanger disposed subsea as described in International Application Publication No. WO2012/151635, which is incorporated in its entirety herein. In summary, in this form the second subsea heat exchanger 116 is arranged to provide heat exchange communication between the gas separated from the first separator 114 and a cooling medium fluid. The cooling medium fluid is circulated through a subsea cooling unit (not shown) comprising one or more subsea cooling modules for cooling the cooling medium fluid. The one or more subsea cooling modules (not shown) comprises a plurality of cooling pipes configured in heat exchange relationship with ambient surrounding seawater.

The cooling medium fluid used in the first and second subsea heat exchangers 112, 116 may be any suitable fluid which is capable of flowing through a respective heat exchange circuit associated therewith and transferring heat from a fluid, such as a hydrocarbon fluid, via the first and second subsea heat exchangers 112, 116. Preferably, the cooling medium fluid has a high thermal capacity, low viscosity, is low cost, non-toxic, and chemically inert, neither causing nor promoting corrosion of the heat exchange circuit.

In general, the cooling medium fluid of the present invention may be a liquid, although in some alternative embodiments of the invention the cooling medium fluid may be a gas.

Suitable examples of cooling medium fluids include, but are not limited to, aqueous media containing additives to inhibit corrosion within the heat exchange circuit, depress the melting point and/or raise the boiling point. In a preferred embodiment the cooling medium fluid comprises water mixed with a suitable organic chemical, such as ethylene glycol, diethylene glycol, or propylene glycol.

In use, the second subsea heat exchanger 116 is configured to further cool the separated gas to below the hydrate formation temperature. In practice, the temperature of the cooled gas will approach the temperature of ambient seawater.

In view of the risk of forming solid hydrates when the separated gas is cooled to below the hydrate formation temperature, the system 10 also includes a means 118 to add a hydrate inhibitor into the separated cooled gas upstream of the second subsea heat exchanger 116. The means 118 to add the hydrate inhibitor into the separated cooled gas may comprise an injector configured to introduce the hydrate inhibitor into a conduit 107 for the separated cooled gas between the separator 114 and the second subsea heat exchanger 116. The hydrate inhibitor may be introduced into conduit 107 in an amount sufficient to ensure no hydrates form under any temperature and pressure conditions within the hydrate formation envelope present in the flowpath of the single phase dew-pointed gas and its upstream precursor gas.

The subsea processing system 100 may also include a second cooling stage 160 comprising a gas-gas heat exchanger 120 in serial combination with an expander 122 disposed downstream of the injector 118. The gas-gas heat exchanger 120 and the expander 122 are configured to receive and further cool the gas-hydrate inhibitor mixture to condense the remaining condensable liquids and produce a dry single phase gas. Disposed downstream of the expander 122 is a separator 124 to separate the condensed liquids from the dry single phase gas. Preferably the separator 124 is a high performance separator configured to remove a high percentage of condensed liquids from the gas stream. The separated condensed liquids are transported to the surface production facility 300 for further processing in the low pressure processing system 310 via risers 106.

The gas-gas heat exchanger 120 may be in the form of a shell & tube heat exchanger. The gas cooling medium of the gas-gas heat exchanger 120 may be the dry single phase gas separated in separator 124, which may be passed through the gas-gas heat exchanger 120 prior to transport to the onshore production facility 200.

The expander 122 may be any suitable device to reduce the pressure of the gas, thereby cooling the gas. Exemplary expanders may include, but are not limited to, Joule-Thomson valves, turbo-expanders, venturi tubes, laval nozzles and so forth, as will be well known to those skilled in the art. The expander 122 may also be referred to as a pressure let-down device. In a preferred embodiment, the expander 122 may be a Joule-Thomson valve. Expanding the gas through a Joule- Thomson valve will achieve a sufficient temperature reduction while at the same time controlling and minimizing a corresponding reduction in pressure. Expander 122 is configured to reduce the pressure of the gas to produce a temperature and gas composition corresponding to a dry single phase gas stream. The degree of pressure reduction will be controlled by the expander 122. Preferably, the pressure reduction will be in a range of 5-15 bar.

Preferably, the physical distances between the gas-gas heat exchanger 120, the expander 122 and the separator 124 may be minimized to reduce the risk of heat leakage. In some embodiments, the gas-gas heat exchanger 120, the expander 122 and the separator 124 may be directly coupled to one another in serial combination.

It will also be appreciated that separator 124 will be of sufficient size and dimensions to perform its duty. The separator 124 may be any one or a combination of types of separators including in-line pipe separators and vessel-type separators.

Referring now to the embodiments described with reference to FIGS. 5 and 6, the second cooling stage 160 omits the gas-gas heat exchanger 120 in serial combination with an expander 122 disposed downstream of the injector 118 shown in FIGS. 3 and 4. Rather, gas cooled in gas-gas heat exchanger 116 is passed directly to separator 124 to separate the condensed liquids from the dry single phase gas. In these particular embodiments, the separator 124 is adapted to also remove water from the cooled gas.

In FIG. 5, the separator 124 is directly coupled to, and is in fluid communication with, a dehydration column section 126. The dehydration column section 126 is configured to receive a volume of hydrate inhibitor via inlet 128. The water and hydrate inhibitor mixture, and any residual hydrocarbon liquids are removed from a common outlet 130 in the dehydration column 126. The liquid stream is transported to the surface facility 300 for further processing by the low pressure processing system 310. The dry gas is transported to the onshore production facility 200 via subsea pipeline.

In FIG. 6, the separator 124 is provided with a dehydration column section 126 in an upper section thereof. The dehydration column section 126 is configured to receive a volume of hydrate inhibitor via inlet 128. The water and hydrate inhibitor mixture, and any residual hydrocarbon liquids are removed from a common outlet 130 in the separator 124. The resulting liquid stream is transported to the surface facility 300 for further processing by the low pressure processing system 310. The dry gas is transported to the onshore production facility 200 via subsea pipeline.

The effect of using a dehydration column section 126 in combination with the separator 124 is to achieve an increased degree of dryness (water removal from the gas) than by cooling alone. The column height of the dehydration column section 126 is relatively small. Without any pre-cooling, however, the dehydration column section 126 would need to be a significant height which would detract from its cost and practicality in the subsea environment.

The system 100 may further comprise one or more subsea compressors 132 to compress the dry single phase gas.

In view of the preceding discussion, it will become apparent to the skilled person that the process and system described herein is a hybrid of both high pressure subsea processing for the main gas product and low pressure surface processing for the separated condensed liquids and inhibitor regeneration. The combination of high pressure subsea gas processing and low pressure surface liquids processing are respectively undertaken at the appropriate location to suit the characteristics of the hydrocarbon phase, thereby achieving significant economic, safety and environmental advantages over surface processing alone or subsea processing alone.

Several advantages will become apparent to the skilled addressee including:

- Risers 106, 108 for transport of the separated condensable liquids to the low pressure liquids processing system 310 on the surface production facility 300 may be significantly smaller in diameter (because they merely transport low pressure condensable liquids) than the type of high pressure gas risers conventionally employed to bring high pressure multiphase stream from a subsea well to a surface production facility for further processing.
- The surface production facility 300 may be significantly smaller, leading to lower capital and operating expense as well as crew numbers, because only subsea support services and the low pressure liquids processing system 310 are employed. Extensive topside space and weight for high pressure gas processing system is no longer required.
- Smaller volumes of hydrate inhibitors are required and flow assurance systems are generally reduced in volume and complexity; dry single phase gas may be transported in the absence of a hydrate inhibitor.
- Reduced corrosion to subsea pipelines from transport of dry sour gas or dry hydrocarbon fluid.
- Associated high pressure safety systems including flare and blowdown systems are significantly reduced in size.
- System and method as disclosed may be employed to economically develop stranded gas condensate fields.

It will be appreciated by persons skilled in the art that numerous variations and/or modifications may be made to the above-described embodiments, without departing from the broad general scope of the present disclosure. The present embodiments are, therefore, to be considered in all respects as illustrative and not restrictive.

For example, there may be special circumstances where the system 100 is adapted for the removal of an undesirable component or contaminant other than water. Regardless of the focus, however, the key intention of the system 100 and process is to process the predominant high pressure gas stream subsea thereby avoiding the large cost, safety and other considerations of bringing this high pressure stream to the surface production facility 300 for further processing.

As well as removing water, the process may remove a degree of liquid hydrocarbons from the raw natural gas stream. As previously described, all condensable hydrocarbons could be removed from the raw natural gas stream by cooling it to an appropriate hydrocarbon dewpoint. Alternatively, the high pressure gas may be transported as a "dense phase" still containing much of the lighter liquid hydrocarbons such as propanes, butanes and pentanes. In general, the gas pressure will be maintained at the highest possible pressure to facilitate pipeline transport to a shore location, or an alternative export location, such as a floating liquefied natural gas vessel or FLNG or other end user of the gas.

In alternative embodiments, where the raw natural gas is lean and naturally low in heavier hydrocarbons then little, if any significant volume of liquid hydrocarbons may be produced subsea. In this embodiment, the process may be solely adapted for removal of water.

It is to be understood that, although prior art use and publications may be referred to herein, such reference does not constitute an admission that any of these form a part of the common general knowledge in the art, in Australia or any other country.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the process and system disclosed herein.

I claim:

1. A system for processing natural gas produced from a subsea well comprising:

a high pressure subsea processing system configured, in use, to receive a natural gas produced from a subsea well, separate free and condensable liquids comprising one or both of water and liquid hydrocarbons therefrom, and produce a single phase gas;

a low pressure surface production facility located on a surface of a body of water in association with one or more subsea wells, having a processing system located thereon for processing the free and condensable liquids separated in the high pressure subsea processing system, and wherein the processing system of the low pressure surface production facility is configured to regenerate hydrate inhibitor introduced into the high pressure subsea processing system and recycle the hydrate inhibitor for re-injection into the high pressure subsea processing system;

one or more risers for transporting the separated free and condensable liquids to the processing system on the low pressure surface production facility, and for transporting recycled hydrate inhibitor from the low pressure surface production facility to the high pressure subsea processing system; and, a subsea pipeline to transport the single phase gas produced in the high pressure subsea processing system to an onshore production facility.

2. The system according to claim 1, wherein the high pressure subsea processing system operates at a pressure in a range of 60 to 240 bar.

3. The system according to claim 1, wherein the low pressure processing system operates at a pressure less than 40 bar.

4. The system according to claim 1, wherein the high pressure subsea processing system comprises:

a first cooling stage configured in use to cool the natural gas in direct or indirect heat exchange relation with ambient seawater to above the hydrate formation temperature to produce condensable liquids comprising one or both of water and liquid hydrocarbons;

a first separator to separate the free and condensable liquids from the cooled gas;

a means to introduce a hydrate inhibitor into the separated cooled gas:

a second cooling stage configured in use to cool the hydrate inhibitor-separated cooled gas mixture to below the hydrate temperature to condense residual condensable liquids; and, a second separator to separate the residual condensable liquids to produce a dry single phase gas.

5. The system according to claim 4, wherein first cooling stage comprises a cooling apparatus configured in use to cool the natural gas in direct or indirect heat exchange relation with ambient seawater.

6. The system according to claim 4, wherein the second cooling stage comprises a gas-gas heat exchanger in serial combination with a gas expander, whereby gas expanded by the gas expander is employed as a heat exchange medium in the gas-gas heat exchanger.

7. The system according to claim 6, wherein the gas-gas heat exchanger, the expander and the second separator are closely positioned with respect to one another or directly coupled to one another in serial combination.

8. The system according to claim 6, wherein the second separator comprises a dual phase separator vessel in fluid communication with a dehydration column section.

9. The system according to claim 6, wherein the second separator comprises a dual phase separator vessel having an upper section thereof configured as a dehydration column section.

10. The system according to claim 4, wherein the cooling apparatus comprises a conduit for passage of the natural gas therethrough, the conduit being arranged in direct heat exchange relation with ambient seawater.

11. The system according to claim 4, wherein the cooling apparatus comprises a plurality of conduits configured in a parallel network, said network of conduits being arranged in direct heat exchange relation with ambient surrounding seawater.

12. The system according to claim 4, wherein the cooling apparatus comprises a first subsea heat exchanger in heat exchanger relation with a cooling medium fluid comprising seawater directly pumped from surrounding ambient seawater.

13. The system according to claim 4, wherein the cooling apparatus comprises a first subsea heat exchanger in heat exchange relation with a cooling medium fluid from one or more subsea cooling modules.

14. The system according to claim 13, wherein a second subsea heat exchanger is configured upstream of the gas-gas heat exchanger.

15. The system according to claim 14, wherein the second subsea heat exchange is in heat exchange relation with a cooling medium fluid from one or more subsea cooling modules.

16. The system according to claim 13, wherein the subsea cooling modules comprises a plurality of conduits configured in a parallel network, said network of conduits being arranged in direct heat exchange relation with ambient surrounding seawater.

17. The system according to claim 13, wherein the cooling medium fluid used in the first and second subsea heat exchangers is cooled in the one or more subsea cooling modules by heat exchange with ambient surrounding seawater.

18. The system according to claim 1, wherein the high pressure subsea processing system comprises:

a first cooling stage configured in use to cool the natural gas in direct or indirect heat exchange relation with ambient seawater to above a water dewpoint temperature or to below a hydrocarbon dewpoint temperature, to produce condensable liquids comprising one or both of water and liquid hydrocarbons;

a first separator to separate the free and condensable liquids from the cooled gas;

a means to introduce a hydrate inhibitor into the separated cooled gas:

a second cooling stage configured in use to cool the hydrate inhibitor-separated cooled gas mixture to below the water dewpoint temperature to condense residual condensable liquids; and, a second separator to separate the residual condensable liquids to produce a dry single phase gas.

19. A method of processing natural gas produced from a subsea well comprising:

passing the natural gas through a high pressure subsea processing system configured, in use, to separate free and condensable liquids comprising one or both of water and gas condensate, and produce a single phase gas;

transporting the separated free and condensable liquids to a low pressure surface production facility located on a surface of a body of water in association with one or more subsea wells;

processing the received free and condensable liquids in a processing system on the low pressure surface production facility, wherein the low pressure processing system regenerates hydrate inhibitor introduced into the high pressure subsea processing system and recycles the hydrate inhibitor for re-injection into the high pressure subsea processing system; and, transporting the single phase gas to an onshore production facility via a subsea pipeline.

20. The method according to claim 19, wherein the high pressure subsea processing system operates at a pressure in a range of 60 to 240 bar.

21. The method according to claim 19, wherein passing the natural gas through the high pressure subsea processing system comprises:

cooling the natural gas to above the hydrate formation temperature to produce free and condensable liquids comprising one or both of water and liquid hydrocarbons;

separating the free and condensable liquids from the cooled gas;

introducing a hydrate inhibitor into the separated cooled gas to produce a hydrate inhibitor-separated cooled gas mixture;

cooling said mixture to below the hydrate formation temperature to condense residual condensable liquids; and, separating the residual condensable liquids to produce a dry single phase gas.

22. The method according to claim 21, wherein the residual condensable liquids further comprise the hydrate inhibitor.

23. The method according to claim 22, wherein the hydrate inhibitor in the residual condensable liquids is regenerated in the low pressure processing system on the surface production facility and recycled for injection into the high pressure subsea processing system.

24. The method according to claim 21, wherein the natural gas is cooled in direct or indirect heat exchange relation with ambient seawater.

25. The method according to claim 21, wherein cooling said mixture comprises passing said mixture through a gas-gas heat exchanger in serial combination with a gas expander, wherein the separated dry single phase gas is used as a cooling medium in the gas-gas heat exchanger.

26. The method according to claim 19, wherein passing the natural gas through the high pressure subsea processing system comprises:

cooling the natural gas to above a water dewpoint temperature or to below a hydrocarbon dewpoint temperature, to produce free and condensable liquids comprising one or both of water and liquid hydrocarbons;

separating the free and condensable liquids from the cooled gas;

introducing a hydrate inhibitor into the separated cooled gas to produce a hydrate inhibitor-separated cooled gas mixture;

cooling said mixture to below the water dewpoint temperature to condense residual condensable liquids; and, separating the residual condensable liquids to produce a dry single phase gas.

27. The method according to claim 19, wherein the processing system on the low pressure surface production facility operates at a pressure less than 40 bar.

28. The method according to claim 19, wherein processing the received free and condensable liquids in the processing system on the low pressure surface production facility comprises separating water from the hydrocarbon liquids.

29. The method according to claim 28 wherein the separated liquid hydrocarbons undergoes any one of a group of processes including stabilisation to a desired vapour pressure specification; separating the gas condensate into one or more hydrocarbon components by distillation; producing an off-gas for power generation.

30. The method according to claim 19, wherein hydrate inhibitor is separated from the free and condensable liquids.

* * * * *